US006151035A

United States Patent [19]

Okada

[11] Patent Number: 6,151,035

[45] **Date of Patent: *Nov. 21, 2000**

[54] METHOD AND SYSTEM FOR GENERATING GRAPHIC DATA

[75] Inventor: Toyoshi Okada, Tokyo, Japan

[73] Assignee: Sony Computer Entertainment Inc., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/035,553

[22] Filed: Mar. 5, 1998

[30] Foreign Application Priority Data

Mar. 6, 1997 [JP] Japan ..... 9-051423

[51] Int. Cl.[7] ..... G09G 5/36

[52] U.S. Cl. ..... 345/509; 345/430; 345/202

[58] Field of Search ..... 345/430, 507–509, 345/511, 521, 501, 202

[56] References Cited

U.S. PATENT DOCUMENTS

| | | | |
|---|---|---|---|
| 5,760,783 | 6/1998 | Migdal et al. | 345/430 |
| 5,764,237 | 6/1998 | Kaneko | 345/430 |
| 5,798,842 | 8/1998 | Yamazaki | 358/302 |
| 5,877,771 | 3/1999 | Drebin et al. | 345/430 |

FOREIGN PATENT DOCUMENTS

| | | | |
|---|---|---|---|
| 476409 | 3/1992 | European Pat. Off. | G09G 1/16 |
| 0747825 A2 | 12/1996 | European Pat. Off. | G06F 12/08 |
| 2296155 | 6/1996 | United Kingdom | H04N 1/41 |
| WO 92/03815 | 3/1992 | WIPO | G09G 1/16 |

*Primary Examiner*—Kee M. Tung
*Attorney, Agent, or Firm*—Fulwider Patton Lee & Utecht, LLP

[57] ABSTRACT

The second graphic data for display is obtained by performing reduction processing using over-sampling on the first graphic data corresponding to the image generated by performing texture mapping processing based on polygon data, thereby the resolution of an image comprising the first graphic data is enhanced maintaining the memory capacity minimized, thus the display resolution of the second graphic data is enhanced. Further, each pixel of an component of the second graphic data is the average value of adjacent four pixels in the first graphic data, hence, for example, a 16 bit direct color image is equivalent to a 24-bit full color image.

13 Claims, 12 Drawing Sheets

49

49

58

METHOD AND SYSTEM FOR GENERATING GRAPHIC DATA

BACKGROUND OF THE INVENTION

1. Field of the Invention

The present invention relates to a method and system for generating graphic data, and more particularly relates to a method and system for generating graphic data which are capable of operating with reduced memory without deterioration of image quality by way of applying over-sampling of high resolution image to reduce the image.

2. Description of Related Art

Heretofore, data in a frame memory are read out according to the sync signal of a display device such as CRT in a system provided with a frame memory such as personal computer and television game machine which is typical of the entertainment system. In the case that an image is drawn for each frame to display a dynamic image, usually the double buffer system in which a frame memory is divided into a display region and drawing region is used.

In the case of double buffer system, a display region and drawing region are switched synchronously with the vertical retrace line erasing period. An image of the next frame is drawn on a drawing region while an image of a frame drawn on the display region is being displayed, and a smooth dynamic image is thereby displayed.

However, in the case that a dynamic image is displayed using the double buffer system, the memory use increases if drawing resolution is enhanced because a display region and drawing region have the same size.

In addition, fine drawing finer than the display resolution can not be realized.

Further, it is impossible to draw an image using information required for display pixels as drawing pixels.

The present invention is accomplished in view of the above-mentioned problems, it is the object of the present invention to reduce the frame memory use without deterioration of image quality using a frame memory of a limited capacity in the case that a dynamic image is displayed.

SUMMARY OF THE INVENTION

The graphic data generation device described in claim 1 comprises a memory having the first memory region for storing the first graphic data corresponding a prescribed image and the second memory region for storing the second graphic data obtained by reducing the first graphic data, and a graphic data generation circuit for generating the second graphic data for display by performing reduction processing on the first graphic data read out from the first memory region of the memory.

The graphic data display system described in claim 7 is provided with a graphic data generation circuit for generating the first graphic data by performing texture mapping processing based on polygon data, a graphic data generation circuit for generating the second graphic data by performing reduction processing on the first graphic data, a memory for storing the second graphic data, and a display device for displaying the second graphic data stored in the memory.

The graphic data generation method described in claim 9 comprises a step (a) for generating the first graphic data corresponding to a prescribed image by performing texture mapping processing based on polygon data, and a step (b) for generating the second graphic data for display by performing reduction processing on the first graphic data.

According to the graphic data generation device described in claim 1, the memory is provided with the first memory region which stores the first graphic data corresponding to a prescribed image and the second memory region which stores the second graphic data obtained by reducing the first graphic data, and a graphic data generation circuit generates the second graphic data for display by performing reduction processing on the first graphic data read out from the first memory region of the memory.

According to the graphic data display system described in claim 7, the graphic data generation circuit generates the first graphic data by performing texture mapping processing based on polygon data, the graphic data generation circuit generates the second graphic data by performing reduction processing on the first graphic data, the memory stores the second graphic data, and the display means displays the second graphic data stored in the memory.

According to the graphic data generation method described in claim 9, the first graphic data corresponding to a prescribed image is generated by performing texture mapping processing based on polygon data, and the second graphic data for display is generated by performing reduction processing on the first graphic data.

Because the graphic data generation circuit performs reduction processing by way of over-sampling on the first graphic data corresponding to a prescribed image in order to obtain the second graphic data, resolution of the image comprising the first graphic data is enhanced maintaining the memory capacity minimized and the display resolution of the second graphic data is enhanced.

Further, because each pixel which constitutes the second graphic data is the average pixel value of adjacent four pixels in the first graphic data, for example, 16 bit direct color image is changed equivalently to a 24 bit full color image.

The above and other objects, feature, and advantages of the present invention will become apparent from the following description when taken in conjunction with the accompanying drawings which illustrate a preferred embodiment of the present invention by way of example.

DETAILED DESCRIPTION OF THE PREFERRED EMBODIMENTS

Figure 1:
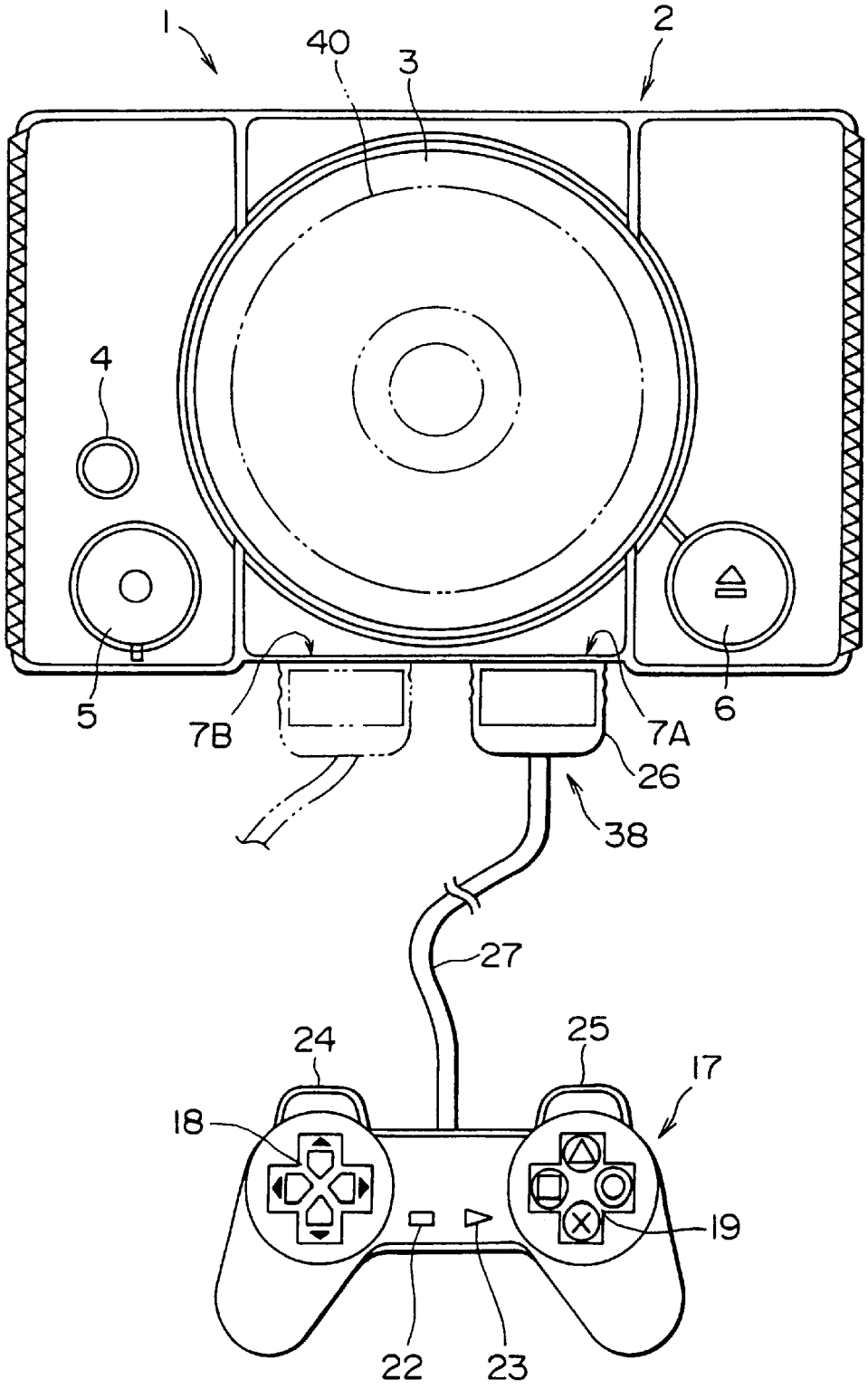
FIG. 1 is a plan view for illustrating one example of a home entertainment system to which the information processing unit of the present invention is applied.
Figure 2:
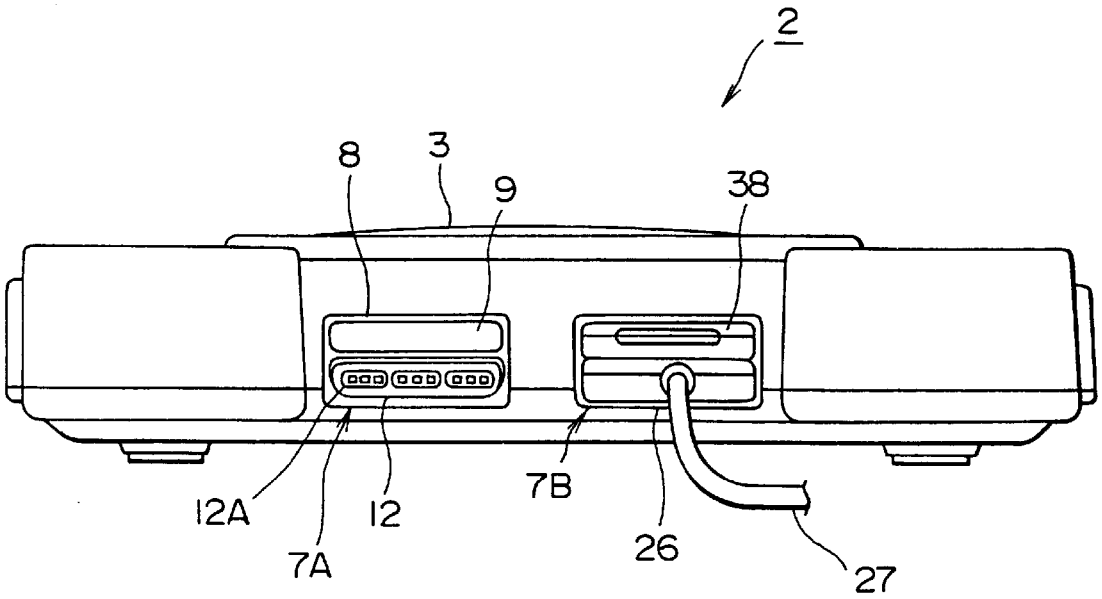
FIG. 2 is a front view of the home entertainment system 1 shown in FIG. 1.
Figure 3:
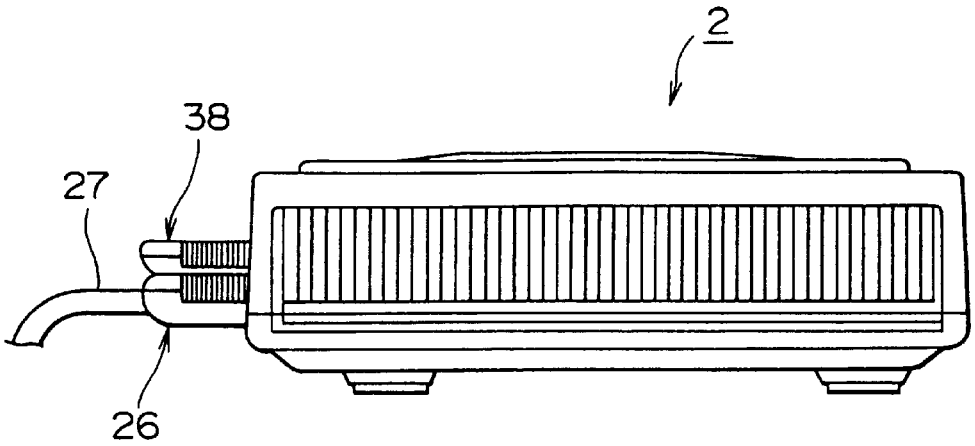
FIG. 3 is a side view of the home entertainment system 1 shown in FIG. 1.

FIGS. 1 to 3 show an example of a home entertainment system to which the present invention is applied. The home entertainment system shown in these drawings comprises an entertainment system body 2, an operation device 17 and recording device 38 connectable to the entertainment system body 2.

Figure 4:
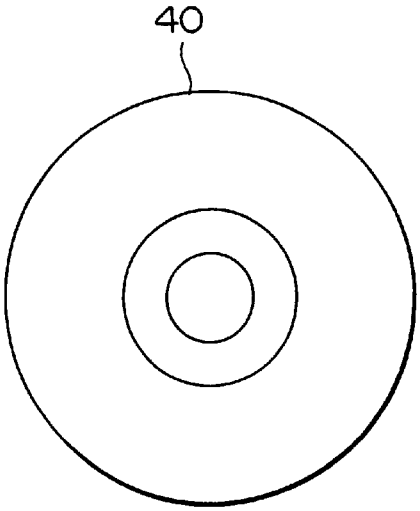
FIG. 4 is a plan view for illustrating one example of a CD-ROM played back on the home entertainment system 1 shown in FIG. 1.

The entertainment system body 2 is formed in an approximately rectangular shape as shown in FIGS. 1 to 3. At the center of the body, the body is provided with a disk support section 3 for supporting a CD-ROM 40 (a disk equivalent to game medium) that is a sort of the optical disk as shown in FIG. 4, a reset switch 4 for resetting desirably a game in running at the desired position on the entertainment system body 2, a power switch 5 for on-off switching of a power source, a disk operation switch 6 for operating disk placement, an operation device 17 for operating so-called game operation, and connection sections 7A and 7B for connecting a recording device 38 for recording so-called game setting.

The connection sections 7A and 7B are formed in two steps as shown in FIGS. 2 and 3. On each upper step of the connection sections 7A and 7B, a recording insertion section 8 is provided respectively for connecting the recording device 38 to the entertainment system body 2. On each lower step of the connection sections 7A and 7B, a connection terminal insertion sections 12 is provided respectively for connecting the operation device 17 to the entertainment system body 2.

The recording insertion section 8 has an insertion hole having a horizontally long rectangular shape, and memory connection terminal section (not shown in the drawing) into which the recording device is inserted. As shown in FIG. 2, the recording insertion section 8 is provided with a shutter 9 for protecting the memory connection terminal section from becoming dusty while the recording device is disconnected. The recording device 38 has a ROM which is writable electrically. The data which is related to so-called game is recorded on the ROM.

In the case that the recording device 38 is mounted on the entertainment system body 2, a user pushes the shutter with the end of the recording device 38 inward; and inserts the recording device 38 into the insertion hole to connect to the memory connection terminal section to complete the mounting work.

The connection terminal insertion section 12 has an insertion hole having a horizontally long rectangular shape and connection terminal 12A for connecting the connection terminal section 26 of the operation device 17 as shown in FIG. 2.

The operation device 17 is structured so that a user can hold the operation device 17 with both palms and operate desirably by free ten fingers as shown in FIG. 1. Further, the operation device 17 is provided with operation sections 18 and 19 disposed in bilaterally symmetrical relation, a select switch 22 and start switch 23 located on the middle between operation sections 18 and 19, connection terminal section 26 for connecting the entertainment system body 2 to the operation device 17, and cable 27.

Figure 5:
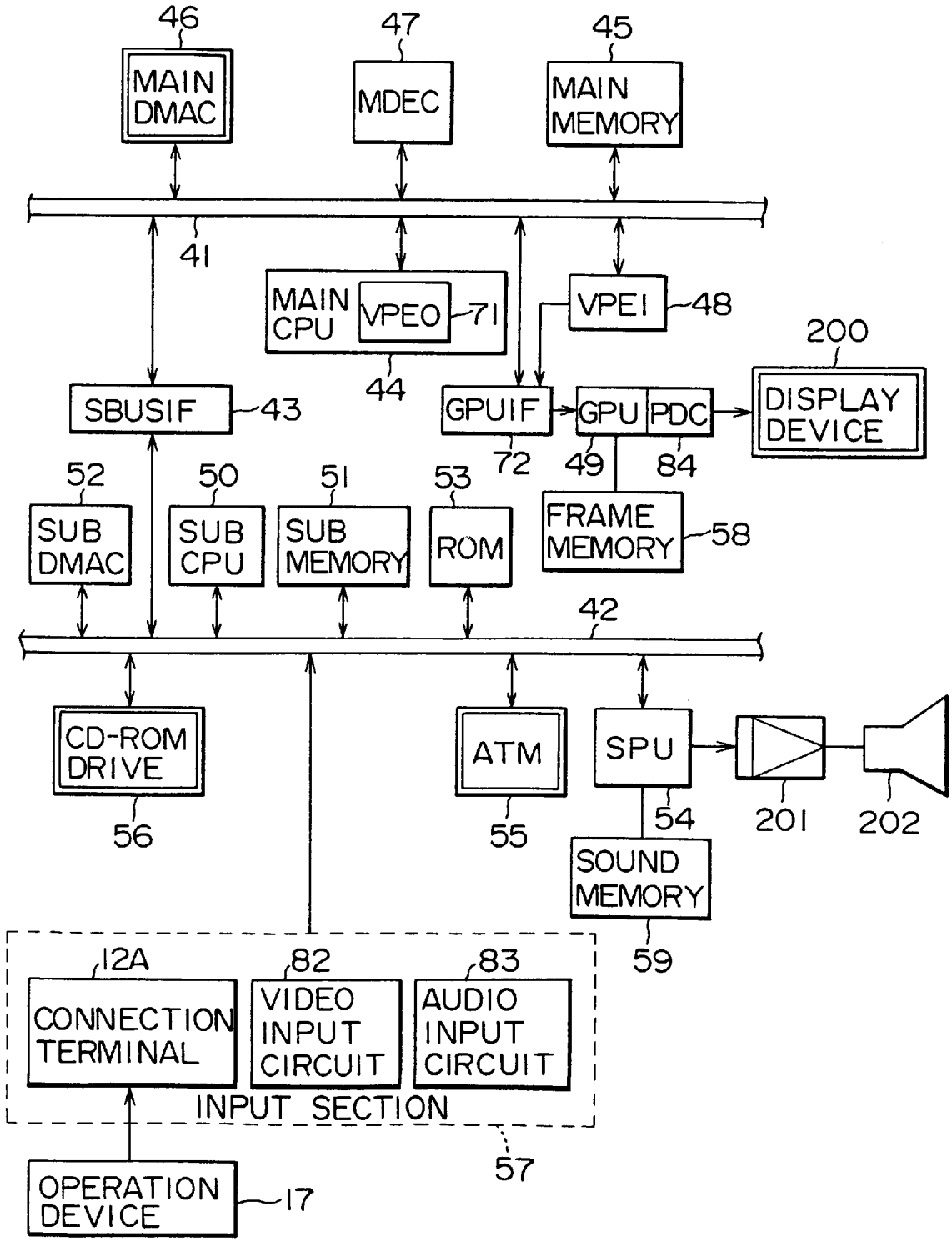
FIG. 5 is a block diagram for illustrating an exemplary internal electrical structure of the home entertainment system 1 shown in FIG. 1.

FIG. 5 shows one example of an internal electrical structure of the above-mentioned entertainment system body 2.

The entertainment system body 2 has total two buses of the main buss 41 and sub-buss 42. These buses are connected to the entertainment system body 2 through SBUSIF (sub bus interface) 43.

The main bus 41 is connected to a main CPU (Central Processing Unit) 44 comprising a micro-processor (not shown in the drawing) and first vector processing engine (VPE0), main memory 45 comprising a RAM (Random Access Memory), main direct memory access controller (main DMAC (Direct Memory Access Controller) 46, MPEG (Moving Picture Experts Group) decoder (MDEC) 47, second vector processing engine (VPE1) 48, and graphical processing unit (GPU) 49 through a GPUIF (graphical processing unit interface) 72. The GPU 49 is provided with a PDC (Programmable display controller) 84.

On the other hand, the sub-bus 42 is connected to a sub-CPU 50 comprising a micro-processor (not shown in the drawing), sub-memory 51 comprising a RAM, sub-DMAC 52, ROM 53 in which programs such as operating systems are stored, sound processing unit (SPU) 54, communication control section (ATM) 55, CD-ROM drive 56 which is served also as a disk support section 3, and input section 57. The operation device 17 is connected to the connection terminal 12A of the input section 57.

The main bus 41 and sub bus 42 are connected by the SBUSIF 43. The data from the main bus 41 is outputted to the sub-bus 42 through the SBUSIF 43, and also the data from the sub-bus 42 is outputted to the main bus 41 through the SBUSIF 43.

The main CPU 44 reads a start program from the ROM 53 connected to the sub-bus 42 through the SBUSIF 43 when the entertainment system body 2 is activated, executes the start program, and operates the operating system.

The main CPU 44 controls the CD-ROM drive 56, reads application programs data, and sound, image, and parameter data from the CD-ROM 40 set on the CD-ROM drive 56, and stores these data in the main memory 45.

The main CPU 44 generates non-regular processing data (polygon definition information) collaboratively with the first vector processing engine (VPE0) 71 in response to the three dimensional object data (coordinate value of the vertex of a polygon (representative point)) comprising a plurality of fundamental figures read from the CD-ROM 40. The first vector processing engine (VPE0) 71 has a plurality of operational elements for arithmetically operating real numbers of floating point, and performs floating point operation in parallel.

In detail, the main CPU 44 and first vector processing engine 71 perform processing which requires fine operation in polygon unit, that is one of the geometry processing, for example, processing to generate data of polygons for describing swinging of leaves with wind or rain drop on a front window of a car. Then, the main CPU 44 and first vector processing engine 71 supply the polygon definition information such as the vertex information of the three-dimensional object obtained by arithmetical operation and shading mode information by way of packet to the main memory 45 through the main bus 41.

A polygon definition information comprises a drawing region setting information and polygon information. The drawing region setting information comprises an offset coordinate in the frame buffer address of the drawing region and an drawing clipping region coordinate. The drawing clipping region coordinate is served to cancel drawing when the coordinate of a polygon is located outside the drawing region. A polygon information comprises a polygon attribute information and vertex information. The polygon attribute information is an information for specifying shading mode, a blending mode, and texture mapping mode. The vertex information is an information for specifying coordinate in the vertex drawing region, coordinate in vertex texture region, and vertex color.

On the other hand, the second vector processing engine (VPE1) 48 has a plurality of operational elements for operating real numbers of floating points like the case of the first vector processing engine 71, and performs. floating point operation in parallel. The second vector processing engine (VPE1) 48 generates the data from which an image is generated by operation of the operation device 17 by a user and processing by the matrix circuit, namely the data (polygon definition information) for relatively simple processing (regular processing) which is not so complicated as is programmed by means of the second vector processing engine 48 (VPE1). For example, the second vector processing engine 48 (VPE1) performs processing such as perspective projection conversion, parallel light source calculation, and two-dimensional curved surface generation of a simple shape of a body such as a building and car, and supplies the polygon definition information generated by these processing to the GPUIF 72.

The GPUIF 72 supplies the polygon definition information supplied from the main CPU 44 from the main memory 45 through the main bus 41 and the polygon definition information supplied from the second vector processing engine 48 to the GPU 49 with arbitrating between two polygon definition information items so that these information items does not collide each other.

The GPU 49 draws an image (referred to simply as "polygon image" hereinafter) which represents the three dimension using the polygon on the frame memory 58-based on the polygon definition information supplied trough the GPUIF 72. The GPU49 cause the frame memory 58 as a texture memory. Therefore, the GPU 49 can perform texture mapping by placing a pixel image on the frame memory as a texture on the polygon.

The main DMAC 46 performs control of, for example, DMA transfer of respective circuits connected to the main bus 41. The main DMAC 46 also controls DMA transfer of respective circuits connected to the sub-bus 42. The MDEC 47 operates in parallel with the main CPU 44, and expands data which were compressed using MPEG system or JPEG (Joint Photographic Experts Group) system.

The sub-CPU 50 operates various operations according to programs stored in the ROM 53. The sub-DMAC 52 controls DMA transfer of respective circuits connected to the sub-bus 42 only while the SBUSIF 43 disconnects the sub-bus 42 from the main bus 41.

The SPU 54 reads sound data from the sound memory 59 in response to a sound command supplied from the sub-CPU 50 or sub-DMAC 52, and outputs it as an audio output from a speaker 202 through driver 201.

The communication control section (ATM) 55 is connected to the public lines, and transmits/receives data through the lines.

The input section 57 has a connection terminal section 12 A for connecting the operation device 17, video input circuit 82 for receiving video data from other devices (not shown in the drawing), and audio input circuit 83 for receiving audio data from other devices (not shown in the drawing).

Figure 6:
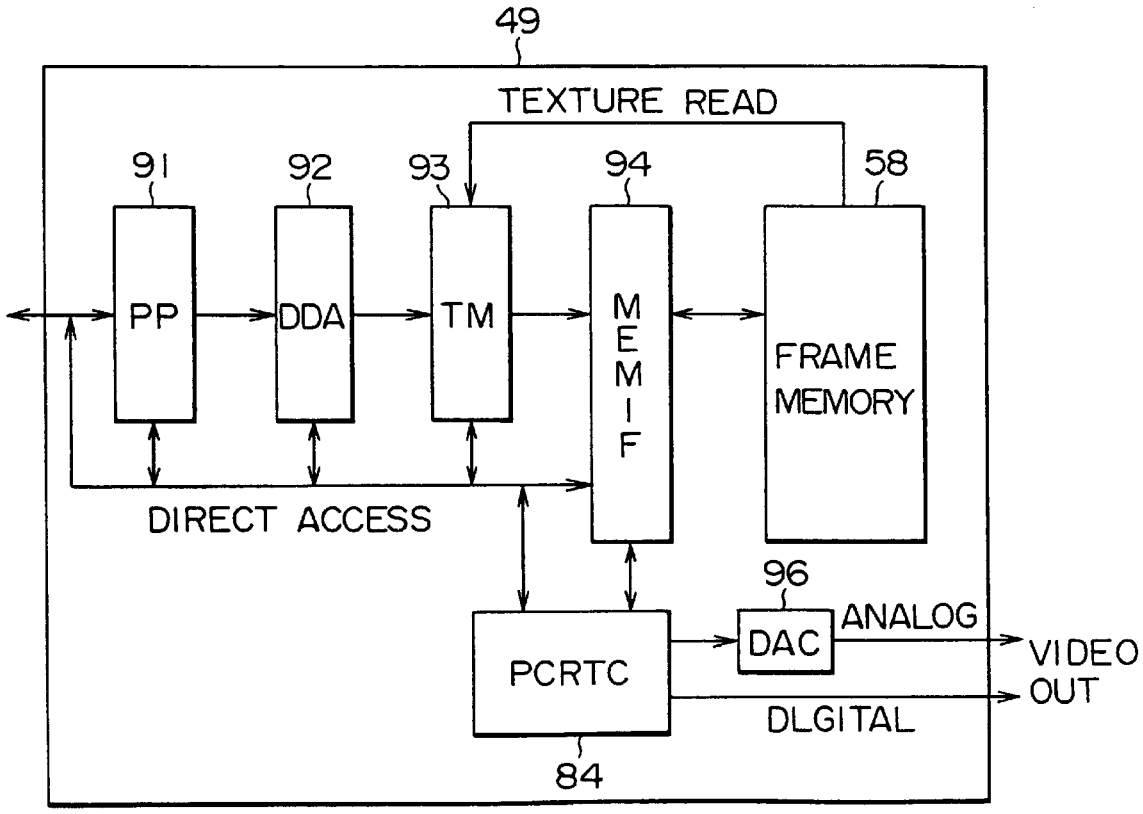
FIG. 6 is a block diagram for illustrating an exemplary structure of a GPU 49.

FIG. 6 is a block diagram for illustrating an exemplary structure of the GPU 49. The Pre Processor (PP) 91 performs pre-processing for performing polygon drawing such as generation of various parameters. Herein, the various parameters means parameters for setting in the DDA (Digital Differential Analyzer) 92 described hereinafter and parameters for specifying operation mode, namely Alpha Blending ON/OFF, Texture Modulate ON/OFF, of the texture mapping section (TM Texture Mapping)) 93 served as a graphic data generation device.

The DDA 92 comprises an accumulator and generates pixel information. The TM 93 performs texture mapping processing. The memory interface (MEMIF) 94 performs interface processing for taking an access to the frame memory 58.

The frame memory 58 is used as a frame memory and texture memory, and stores the polygon drawing data and texture data. The texture data stored in the frame memory 58 are read as desired by the texture mapping section 93, and the read texture data is used for placing it on a polygon.

PDC 84 reads the drawing data stored in the frame memory 58 through the MEMIF 94, and outputs the read drawing data as the digital video data of two series. The Digital to Analog converter (DAC) 96 converts the one series of video data from the PDC 84 to an analog video signal, and output it. A display device 200 such as a CRT or LCD is connected to the PDC 84.

Figure 7:
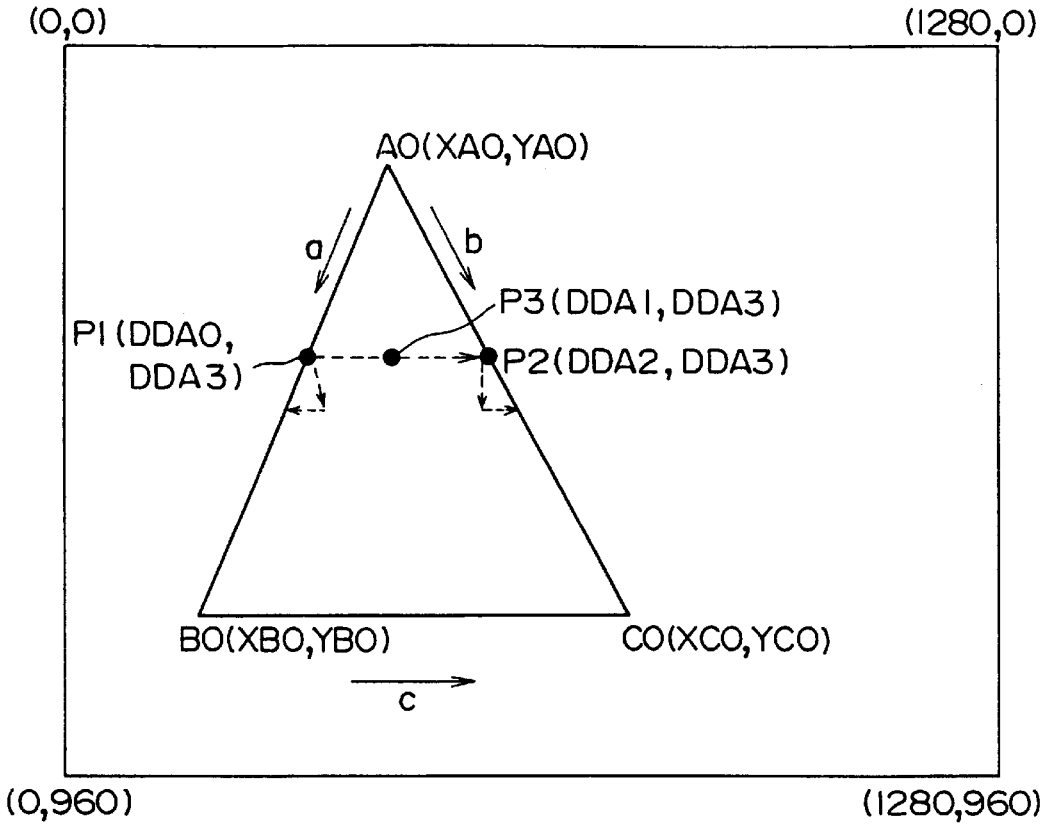
FIG. 7 is a diagram for describing procedures for drawing a triangle.
Figure 12:
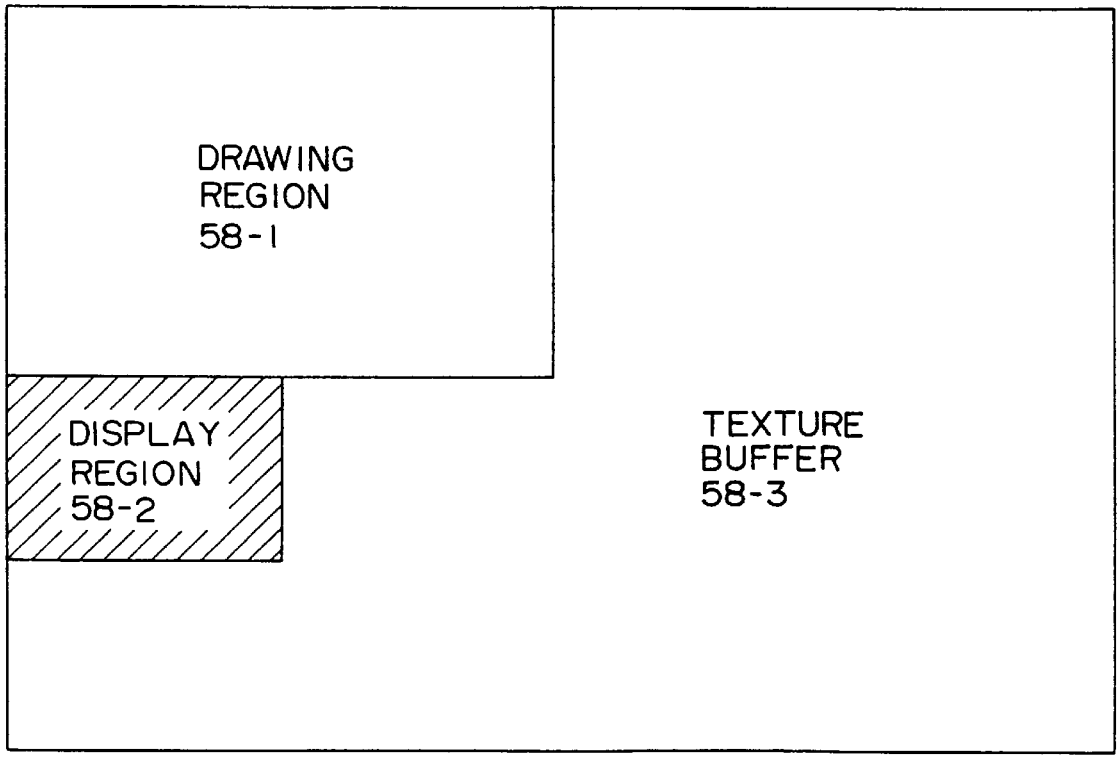
FIG. 12 is a diagram for describing an exemplary region set in the frame memory 58.

An example in which a triangle is drawn is described with reference to FIG. 7. FIG. 7 shows the drawing region 58-1 (refer to FIG. 12) of the frame memory 58, coordinates of the upper left corner, upper right corner, lower left corner, and lower right corner are respectively (0,0), (1280,0), (0,960), and (1280,960), wherein the unit is a pixel. As shown in FIG. 7, in the case that a triangle having vertexes A0 (XA0, YA0), B0 (XB0, YB0), and C0 (XC0, YC0) is drawn, first the respective coordinates of vertexes A0, B0, and C0 are given to the PP 91 as input data. The vertex which is located in the left (in this example, vertex A0) out of top vertexes on the screen is used as the starting vertex. The vertex which is located in the left out of vertexes excepting the starting vertex (in this example, vertex B0) is assigned as the second vertex, and the residual vertex (in this example, C0) is assigned as the third vertex. When, the PP 91 calculates the gradient "a" of the line drawn from the starting vertex to the second vertex (displacement of x-coordinate when y-coordinate is displaced by 1), a gradient "b" of the line drawn from the starting vertex to the third vertex, and a gradient "c" of the line drawn from the second vertex to third vertex, and these gradient values "a", "b", and "c" are set respectively to the DDA 92. For the purpose of simplification herein, it is assumed that y-coordinate of the second vertex is the same as y-coordinate of the third vertex.

In DDA 92, the following calculation is operated based on the data set by means of the PP 91. Herein DDA0 to DDA3 are variables. The point P1 shown in FIG. 7 is the starting point when the triangle is drawn, the point P2 is the end point when the triangle is drawn, and the point P3 represents the pixel between the point P1 and the point P2. The respective coordinates of the starting point P1, end point P2, and the point P3 between the starting point P1 and end point P2 are (DDA0, DDA3) (DDA2, DDA3), (DDA1, DDA3), variables DDA0, DDA2, and DDA1 are horizontal x-coordinate values, and variables DDA3 is a vertical y-coordinate value. The triangle is drawn by repeating the step (0) and steps (1) to (4).

(0) assuming that set value of DDA0 is XA0, and addition value is "a"
  assuming that set value of DDA1 is XA0, and addition value is 1
  assuming that set value of DDA2 is XA0, and addition value is "b"
  assuming that set value of DDA3 is YA0, and addition value is 1

(1) the addition value is added to the set value of DDA1

(2) if DDA1 value≧DDA2 value in DDA0, DDA2, and DDA3, the addition value is added to the set value, and the value of DDA0 is set to DDA1.

(3) if DDA3≧YB0, the processing is brought to an end.

(4) DDA1 value is outputted as x-coordinate of the output pixel and DDA3 value is outputted as y-coordinate of the output pixel, and the processing returns to (1).

In the above-mentioned processing, the triangle is drawn as described herein under. As shown in FIG. 7, "1" is added successively to the variable DDA1 which is the horizontal coordinate value of the point P3, and a line which is part of the triangle is thereby drawn successively from the starting point P1 toward the end point P2 one pixel by one pixel as shown with a solid line arrow C. When the value of the variable DDA1 exceeds the value of the variable DDA2 which is the value of the end point, "1" is added to the variable DDA3 which is the vertical coordinate value, simultaneously "a" is added to the variable DDA0 which is the horizontal coordinate value of the starting point P1, and "b" is added to the variable DDA2 which is the horizontal coordinate value of the end point P2. Hence, as shown with a dashed line arrow and solid line arrow "a" under the starting point P1 in FIG. 7, the position of the starting point P1 is changed, and as shown with a dashed line arrow and solid line arrow "b" under the end point P2, the position of the end point P2 is changed. As shown with a solid line arrow C, a line which is part of the triangle is drawn from the starting point P1 which is changed in position to the end point P2 which is changed in position successively as described herein above one pixel by one pixel.

As described herein above, in the DDA 92, coordinate of the pixel to be drawn is calculated using the accumulator along the raster. The DDA 92 calculates also the gradient of vertex color similarly and coordinate in the texture space in addition to the acquisition of drawing coordinate in order to realize glow shading.

The above-mentioned various respective data calculated by the DDA 92 are supplied to the TM 93. The TM 93 reads the texture data from the frame memory 58 based on the data supplied from the DDA 92, and writes a prescribed image (the first graphic data) on the drawing region (the first memory region) 58-1 of the frame memory 58 through the MEMIF 94 i.e., display blanking or vertical display blanking. During retrace line erasing period, regarding the entire region of the drawing region 58-1 as the texture data, the TM 93 reduces the image drawn thereon by way of Bi-linear texture mapping method, which will be described hereinafter, to generate a reduced image (second graphic data), and draws the reduced image on the display region (second memory region) 58-2 (refer to FIG. 12).

The PDC 84 reads the graphic data of the image drawn on the display region 58-2 of the frame memory 58 through the MEMIF 94, and outputs the graphic data as two series of digital video signal. One series out of two is converted to an analog video signal in the DAC 96, and outputted on the screen of a display 200 as an image.

Figure 8:
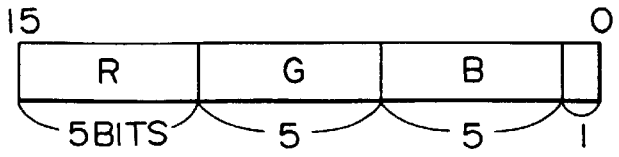
FIG. 8 is a diagram for illustrating an exemplary pixel format of an image stored in the drawing region of the frame memory 58.

FIG. 8 shows a data format of a pixel stored in the frame memory 58. Each pixel is represented by total 16 bits comprising bits from bit 0 to bit 15. In the first bit 0, alpha information for indicating transparent information is contained. In the next 5 bits (from bit 1 to bit 5), pixel data of blue (B) component is contained. In the next 5 bits (from bit 6 to bit 10), pixel data of green (G) component is contained. In the final 5 bits (bit 11 to bit 15), pixel data of red (R) component is contained.

Figure 9:
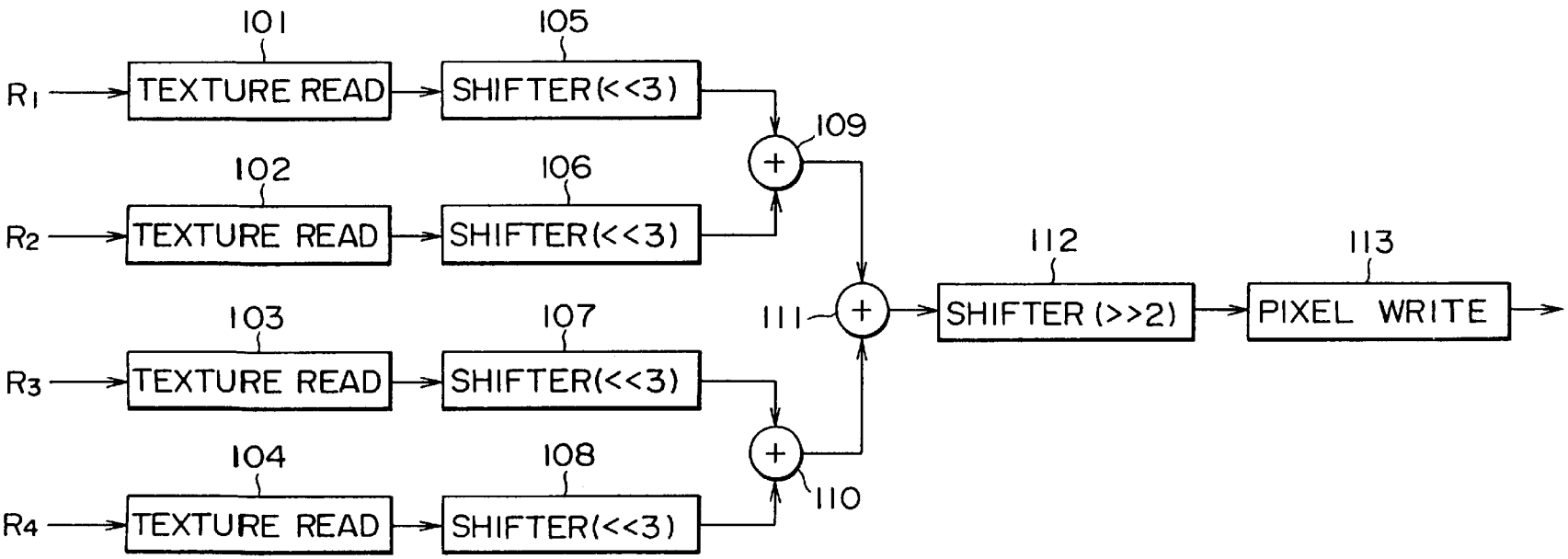
FIG. 9 is a block diagram for illustrating an exemplary built-in average value output circuit in the TM 93 shown in FIG. 6.

FIG. 9 shows an example of the average value output circuit which extracts data of a prescribed color component of R, G, and B out of pixel data stored in the format shown in FIG. 8 every 4 pixels and calculates the average value of these data. Circuits as shown in FIG. 9 are provided in the TM 93 respectively for R component, G component, and B component.

The texture read sections 101 and 102 read the pixel data corresponding to the red components R1 and R2 of a prescribed pixel of the texture data stored in the drawing region (drawing region) 58-1 (refer to FIG. 12) of the frame memory 58 and outputs it. Further, the texture read sections 103 and 104 read the pixel data corresponding to the red components R3 and R4 of another prescribed pixel of the texture data from the frame memory 58 and outputs it.

The shifters 105, 106, 107, and 108 shift the texture data supplied respectively from the texture read sections 101, 102, 103, and 104 by 3 bits in the MSB (Most Significant Bit) direction, and then outputs them. In other words, the shifters 105, 106, 107, and 108 convert the texture data having 5 bits to a texture data having 8 bits and output them.

The adder 109 adds the output from the shifter 105 to the output from the shifter 106. The adder 110 adds the output from the shifter 107 to the output from the shifter 108. Further, the adder 111 adds the output from the adder 109 to the output from the adder 110.

The shifter 112 shifts the output from the adder 111 by 2 bits in the direction of the LSB (Least Significant Bit) In other words, by performing the shift processing, the shifter 113 divides the total of respective R component pixel values of added 4 pixels which are added by means of the adders 109 to 111 by 4 to figure out the average value. The pixel write section (Pixel write) 113 writes the average pixel data of 8 bit R component outputted from the shifter 112 on the display region 58-2 (FIG. 12) of the frame memory 58.

The same structure as the circuit shown in FIG. 9 is provided in the TM 93 respectively for G component and B component. Like the processing for calculating the average value of the pixel value of R component of the above-mentioned four pixels, those circuits calculate respective averages of G component and B component every 4 pixels. These average values are written in the drawing region 58-2 of the frame memory 58.

Figure 10:
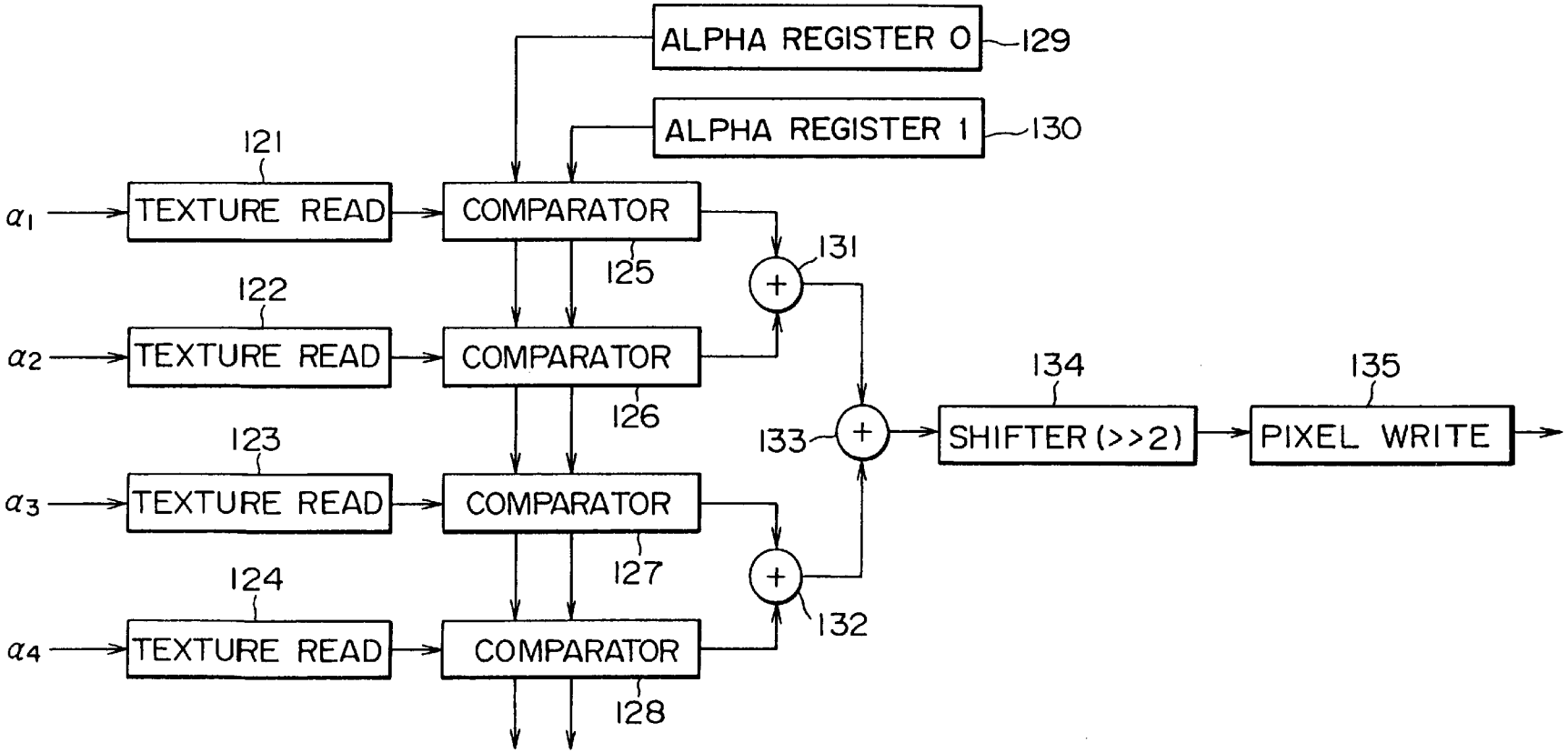
FIG. 10 is a block diagram for illustrating an exemplary built-in alpha value output circuit in the TM 93 shown in FIG. 6.

The alpha-value output circuit shown in FIG. 10, provided in the TM93 shown in FIG. 6, extracts the 1 bit alpha information for indicating the mixing ratio out of the pixel data stored in the frame memory 58 in the format shown in FIG. 8 every adjacent 4 pixels in the drawing region 58-1 and figures out those average values.

The texture read sections 121 and 122 read alpha information ($\alpha 1$) and ($\alpha 2$) of the prescribed pixel stored respectively in the drawing region 58-1 of the frame memory 58 and output them. The texture read sections 123 and 124 read alpha information ($\alpha 3$) and ($\alpha 4$) of another prescribed pixel stored respectively in the drawing region 58-1 and output them.

The comparators 125, 126, 127, and 128 detect respectively whether the value of alpha information ($\alpha 1$), ($\alpha 2$), ($\alpha 3$), and ($\alpha 4$) supplied from the texture read sections 121, 122, 123, and 124 are 0 or 1, and if the values of supplied alpha information ($\alpha 1$), ($\alpha 2$), ($\alpha 3$), and ($\alpha 4$) are "0", then the comparator 125, 126, 127 and 128 outputs respectively the alpha information of 8 bits stored in the alpha register (Alpha register 0) 129, on the other hand, if the values of alpha information ($\alpha 1$), ($\alpha 2$), ($\alpha 3$), and ($\alpha 4$) are "1", the respective alpha values stored in the alpha register (Alpha Register 1) 130 are outputted.

The adder 131 adds the output of the comparator 125 to the output of the comparator 126. The adder 132 adds the output of the comparator 127 to the output of the comparator 128. The adder 133 adds the output of the adder 131 to the output of the adder 132.

The shifter 134 shifts the output of the adder 133 by 2 bits in the LSB direction. In detail, by performing the shift processing, the shifter 134 divides the total of alpha values of 4 pixels added by the adder 133 by 4 to figure out the average value. The pixel write section 135 writes the average value (8 bits) of the alpha value outputted from the shifter 134 on the display region 58-2 of the frame memory 58. Circuits as shown in FIG. 10 are provided in the TM 93 respectively for R component, G component, and B component.

Figure 11:
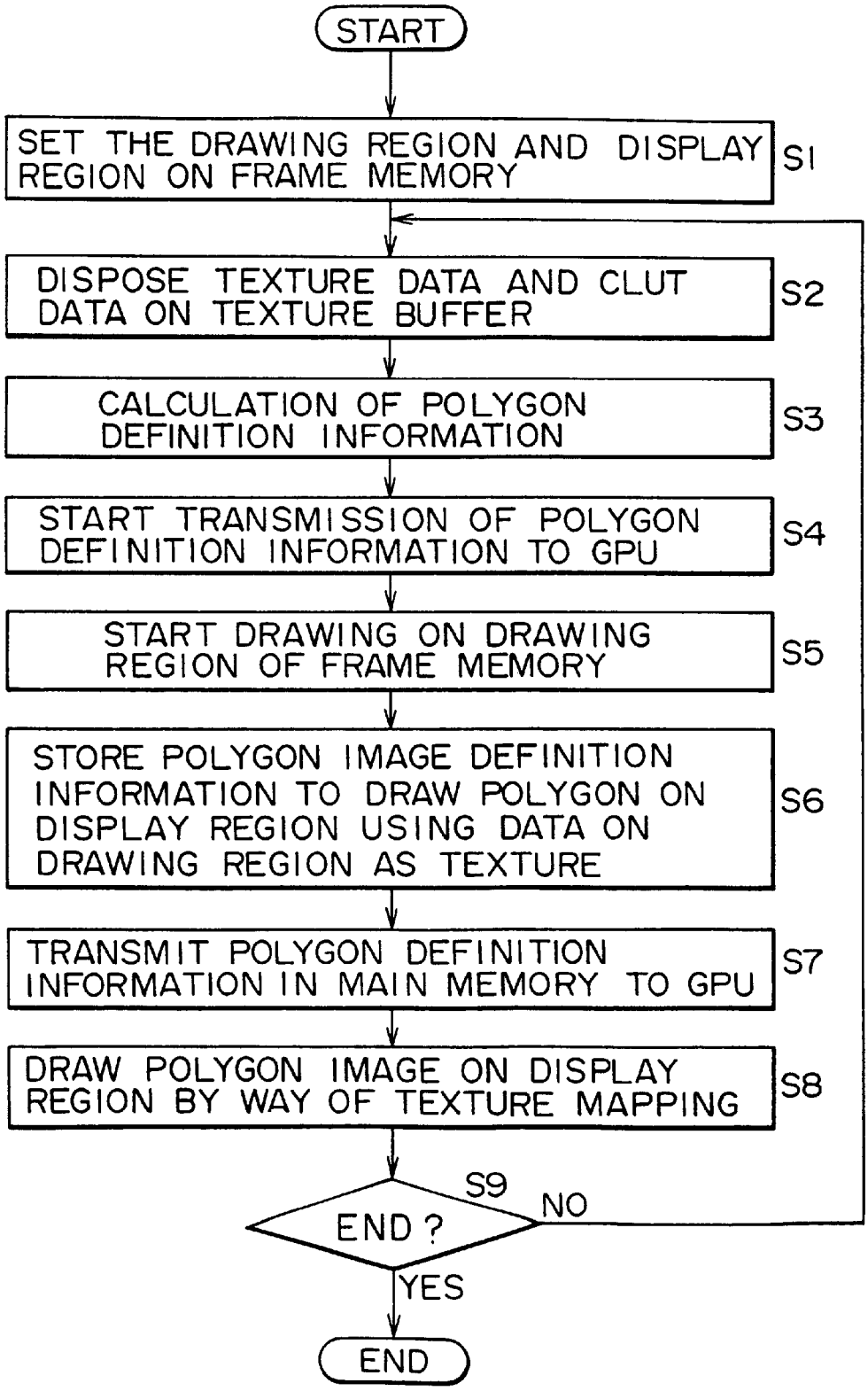
FIG. 11 is a flow chart for describing the sequence in Bi-linear texture mapping.

Next, operations of the entertainment system body 2 shown in FIG. 5 are described with reference to the flow chart in FIG. 11. In the step SI, the main CPU 44 generates a command for initializing the frame memory 58 provided to the GPU 49, and stores it in the main memory 45. The "command" means a command for setting the drawing region 58-1 and display region 58-2 in the frame memory 58 (refer to FIG. 12), and a command for setting the offset of the coordinate and so on. The main DMAC 46 transmits the above-mentioned commands stored in the main memory 45 to the GPU 49 through the GPUIF 72.

In the step S2, the main DMAC 46 transmits the texture data which is previously stored in the main memory 45 and CLUT (Color Look Up Table) data to the GPU 49 through the GPUIF 72, and disposes them in the texture buffer 58-3 of the frame memory 58.

In the step S3, the main CPU 44 calculates the polygon definition information comprising vertex information, shading mode information, texture information; and vertex color information required for drawing using the first vector processing engine (VPE0) 71, and stores it in the main memory 45 .

In the step S4, the main DMAC 46 starts transmission processing of the polygon definition information stored on the main memory 45 to the GPU 49 through the GPUIF 72.

Figures 13A, 13B, 13C:
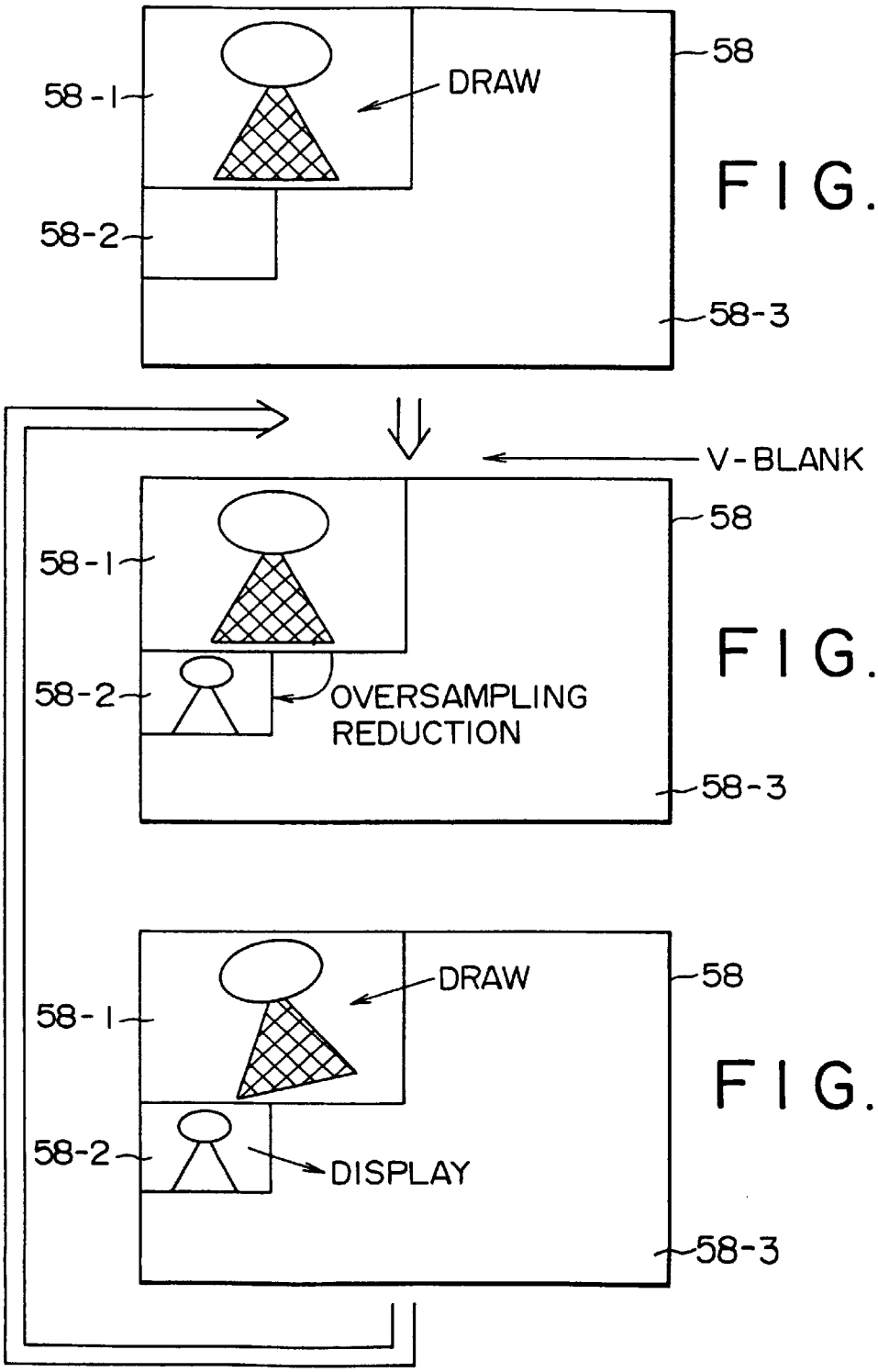
FIG. 13A is a diagram for illustrating the drawing of a polygon image in the drawing region.
FIG. 13B is a diagram for illustrating the arrangement in the display region of the display-polygon graphic data obtained by over-sampling the polygon image stored in the drawing region.
FIG. 13C is a diagram for illustrating the drawing of a new polygon image in the drawing region and the reading for displaying of the polygon image stored in the display region.

In the step S5, the GPU 49 performs texture mapping processing and starts drawing of the polygon image on the drawing region 58 of the frame memory 58 according to the polygon definition information transmitted through the GPUIF 72 as shown in FIG. 13A.

In the step S6, after the processing which started in the step S4 was completed, regarding the polygon image stored on the drawing region 58-1 as a texture, the main CPU 44 stores the polygon definition information for drawing the image on the display region 58-2 using the polygon image data in the main memory 45.

In the step S7, the main DMAC 46 transmits the polygon definition information stored in the main memory 45 in these step S6 to the GPU 49 through the GPUIF 72.

In the step 8, regarding the polygon image drawn on the drawing region 58-1 on the frame memory 58 as a texture, the GPU 49 draws the reduced polygon image regarded as a texture on the display region 58-2 as shown in FIG. 13B. When, the GPU 49 performs reduction processing of the polygon image regarded as a texture using the Bi-linear texture mapping method described hereinafter.

As shown in FIG. 13C, the PDC 84 outputs a video signal corresponding to the image drawn on the display region 58-2, and the video signal is displayed on a display device 200.

In the step S9, the main CPU judges whether the above-mentioned polygon processing is completed on every frames. If the judgement indicates that polygon processing is completed not on every frames, the sequence returns to the step S2, and the processing of the step S2 and after the step S2 is performed. In the step S5, as shown in FIG. 13C, a polygon image to be displayed in the next frame is drawn on the drawing region 58-1. On the other hand, if the main CPU 44 judges polygon processing to have been completed on every frames, then the processing is brought to an end.

Figure 14:
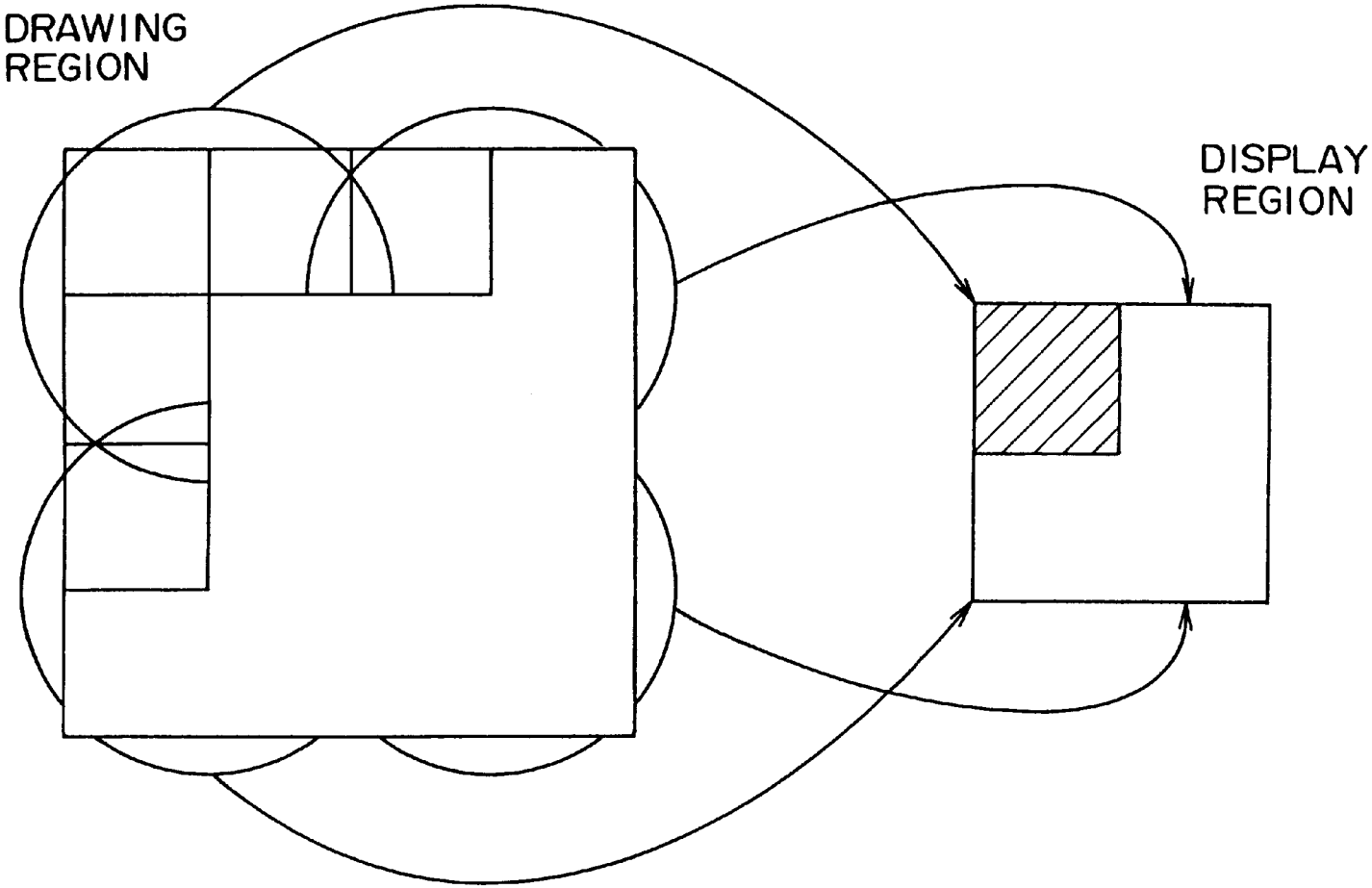
FIG. 14 is a diagram for describing the operation of Bi-linear texture mapping.

Bi-linear texture mapping is described with reference to FIG. 14. FIG. 14 shows an arbitrary 4×4 pixel region on the drawing region of the frame memory 58 and a 2×2 pixel region corresponding to the above-mentioned 4×4 pixel region on the display region 58-2. Color resolution of each pixel drawn on the drawing region 58-1 is 16 bit direct color. As described hereinbefore with reference to FIG. 8, each pixel has 16 bits comprising 5 bits respectively for R, G, and B and 1 bit for alpha bit.

First, a pixel value represented by 5 bits of 2×2 pixels located at the upper left corner out of the 4×4 pixels are extracted, and these pixels are inputted to the texture read sections 101 to 104 of the average value output circuit shown in FIG. 9. The inputted respective pixel values are shifted by 3 bits respectively in the MSB direction in the shifters 105 to 108, thereby the value is multiplied by 8 to convert it to 8 bit value. These values are added by the adders 109, 110, and 111, and shifted by 2 bits in the LSB direction by the shifter 112, thereby the value is divided by 4. Thereby, an average of the value that 4 pixels are multiplied by 8 to convert it to 8 bit value is obtained.

To express the pixel value of each pixel which is represented by the above-mentioned 16 bit direct color, the value of R, G, and B of each pixel is changed to 8 bit value. Finally, the value of R, G, and B of each pixel is outputted in the form of 8 bit data respectively, and written on the display region by the pixel write section 113.

On the other hand, alpha information items having 1 bit of the respective pixels are inputted to the texture read sections 121 to 124 of the alpha value output circuit shown in FIG. 10. The comparators 125 to 128 detects whether the input alpha information is 0 or 1, and depending on the detection result, any one of alpha values stored in the alpha register 129 and alpha register 130 is replaced with the input respective alpha information. The alpha value set in the alpha registers 129 and 130 can be changed, for example, every one polygon.

The respective alpha values of the four pixels having replaced alpha information are added by the adders 131 to 133, and then it is divided by 4 to calculate the average value of the respective alpha values of the four pixels corresponding to the respective alpha information items.

The average value of the alpha value having 8 bits is supplied to the pixel write section 135, and written on the display region 58-2 of the frame memory 58 through the MEMIF 94. Hence, the pixels located at the upper left corner of the display region 58-2 shown in FIG. 14 is drawn.

Next, 4 pixels located on the right side of the above-mentioned 4 pixels on the drawing region 58-1 is subjected to the same processing as described herein above, and the corresponding data are written on the display region 58-2. Similarly as described herein under, average values of all the pixels drawn on the drawing region 58-1 are obtained every 4 bits, and drawn on the display region 58-2 as the value of one pixel.

The PDC 84 outputs digital video signal of two series corresponding to each pixel based on the pixel value of each pixel drawn on the display region 58-2 of the frame buffer 58. One series out of two series is converted to an analog signal and then outputted as an analog video signal.

As described herein above, 16 bit direct color image having 5 bits of R component, 5 bits of G component, 5 bits of B component, and 1 bit of alpha information drawn on the drawing region 58-1 is reduced to ½ respectively in horizontal and vertical direction (the number of pixels are reduced to ¼), and is drawn on the display region 58-2 in the form of 24 bit full color image. Because information of 4 pixels of the image drawn on the drawing region 58-1 is reflected on each pixel of the image drawn on the display region 58-2 by the above-mentioned over-sampling, the resultant image contains substantially the information of precision finer than one pixel for one pixel. Therefore, it is possible to display an image which is clear and sharp at the polygon periphery, namely the edge, of the displayed image which is read out from the display region and displayed by the display device and has high resolution.

Hence, drawing resolution can be enhanced to a level finer than display resolution, and the enhanced resolution allows memory use to be reduced without deterioration of drawing quality. Further, enhanced resolution leads to fine graphical drawing regardless of display resolution. As the result, an image of high resolution finer than the display resolution can be displayed. Further, because apolygon image once drawn is subjected to over-sampling and displayed, color resolution per one drawing pixel can be reduced from that of display pixel, therefore memory use can be reduced.

In the embodiment described herein above, a pixel value average of 4 pixels is calculated in Bi-linear texture sampling. However, a pixel value average of arbitrary number of pixels may be calculated.

In the above embodiment, there showed an example of connecting the speaker 202 via the display unit 200 and the driver 201. These units may be constituted as an integrated type or portable type.

The example in which the speaker 202 is connected through the display device 200 and driver 201 has been described, however these components may be combined or may be structured in potable style.

Although a certain preferred embodiment of the present invention has been shown and described in detail, it should be understood that various changes and modifications may be made therein without departing from the scope of the appended claims.

What is claimed is:

1. A two-buffer graphic data generation device comprising:

a frame memory having a first memory region for storing first graphic data corresponding to a prescribed image and a second memory region for storing second graphic data obtained by reducing said first graphic data, said second graphic data being output as a video signal to be displayed on a display device; and a graphic data generation circuit for generating the second graphic data for display by performing reduction processing on the first graphic data read out from the first memory region of said frame memory during a display blanking period of said display device.

2. The two-buffer graphic data generation device as claimed in claim 1, wherein said reduction processing is over-sampling processing.

3. The two-buffer graphic data generation device as claimed in claim 1, wherein said first graphic data is generated by performing texture mapping processing based on polygon data.

4. The two-buffer graphic data generation device as claimed in claim 1, wherein texture data are stored in the memory region other than the first and second memory regions of said frame memory.

5. The two-buffer graphic data generation device as claimed in claim 4, wherein said graphic data generation circuit uses an average pixel value of a prescribed number of pixels of said first graphic data as a pixel value of a prescribed pixel of said second graphic data.

6. The two-buffer graphic data generation device as claimed in claim 5, wherein the prescribed number of pixels of said first graphic data is four adjacent pixels which are components of said first graphic data.

7. A two-buffer graphic data display system comprising:

a graphic data generation circuit for generating first graphic data obtained by performing texture mapping processing on polygon data and for generating second graphic data obtained by performing reduction processing on said first graphic data;

a frame memory for storing said second graphic data; and display means for displaying the second graphic data stored in said memory, wherein said graphic data generation circuit performs said reduction processing during a display blanking period of said display device.

8. The two-buffer graphic data display system as claimed in claim 7, wherein said graphic data display system is provided with a first memory region for storing said first graphic data, second memory region for storing said second graphic data, and third memory region for storing texture data.

9. A two-buffer graphic data generation method comprising the steps of:

generating first graphic data corresponding to a prescribed image obtained by performing texture mapping processing on polygon data;

generating second graphic data for display obtained by performing reduction processing on said first graphic data;

displaying the second graphic data on a display means; and performing said reduction processing during a display blanking period of said display device.

10. The two-buffer graphic data generation method as claimed in claim 9, further comprising the steps of:

storing said first graphic data in a first memory region of a frame memory;

storing said second graphic data in a second memory region of the frame memory; and storing said texture data in a memory region other than said first and second memory regions of said frame memory.

11. The two-buffer graphic data generation method as claimed in claim 10, wherein the value of each pixel of said second graphic data stored in the second memory region of said frame memory is an average value of adjacent pixels of a prescribed number which are components of the first graphic data stored in the first memory region of said frame memory.

12. The two-buffer data generation method as claimed in claim 9, wherein said reduction processing is over-sampling processing.

13. The two-buffer graphic data generation method as claimed in claim 9, wherein the pixels of a prescribed number of said first graphic data is adjacent four pixels which are components of said first graphic data.

* * * * *